US009831592B2

(12) United States Patent
Ueda et al.

(10) Patent No.: US 9,831,592 B2
(45) Date of Patent: Nov. 28, 2017

(54) ELECTRICAL CONNECTOR AND METHOD FOR MOUNTING ELECTRICAL CONNECTOR ON CIRCUIT BOARD

(71) Applicant: Toyota Jidosha Kabushiki Kaisha, Toyota-shi, Aichi-ken (JP)

(72) Inventors: Kazuhiko Ueda, Susono (JP); Toshiyasu Katsuno, Nagoya (JP); Hitoshi Ozaki, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/078,346

(22) Filed: Mar. 23, 2016

(65) Prior Publication Data

US 2016/0308292 A1 Oct. 20, 2016

(30) Foreign Application Priority Data

Apr. 17, 2015 (JP) ..... 2015-084997

(51) Int. Cl.
*H01R 13/502* (2006.01)
*H01R 13/447* (2006.01)
*H01R 12/71* (2011.01)

(52) U.S. Cl.
CPC ..... *H01R 13/447* (2013.01); *H01R 12/71* (2013.01)

(58) Field of Classification Search
CPC .... H01R 13/447; H01R 12/71; H01R 13/533; H01R 11/01; H01R 13/11
USPC ..... 439/689, 382
See application file for complete search history.

(56) References Cited

U.S. PATENT DOCUMENTS 4,802,868 A * 2/1989 Rolf ..... H01R 13/428 439/689
4,880,399 A * 11/1989 Ichimura ..... H05K 7/1084 439/689
5,354,211 A * 10/1994 Svette, Jr. ..... H01R 13/64 439/381

(Continued)

FOREIGN PATENT DOCUMENTS

JP 2000-067963 A 3/2000
JP 2001-145366 A 5/2001

(Continued)

*Primary Examiner* — Abdullah Riyami
*Assistant Examiner* — Nader Alhawamdeh
(74) *Attorney, Agent, or Firm* — Andrews Kurth Kenyon LLP

(57) ABSTRACT

Provided is an electrical connector mounted on a circuit board and including: a first connection terminal whose one end is electrically connected to the circuit board; a housing for supporting the first connection terminal while having the other end of the first connection terminal surrounded by lateral walls and disposed inside the housing, and having an opening toward an upper part opposite to a bottom part where the housing makes contact with the circuit board; a second connection terminal whose one end is electrically connected to the other end of the first connection terminal and whose other end is electrically connected to an external connection terminal inserted in the electrical connector; a lid for engaging the opening of the housing and covering the other end of the first connection terminal and the second connection terminal. The lid has a penetration hole configured to ventilate the housing.

7 Claims, 11 Drawing Sheets

(56) References Cited

U.S. PATENT DOCUMENTS

| | | | | |
|---|---|---|---|---|
| 5,643,016 | A * | 7/1997 | Huss, Jr. | H01R 13/434 439/689 |
| 6,315,591 | B2 * | 11/2001 | Oda | H01R 13/6315 439/246 |
| 8,814,605 | B2 * | 8/2014 | Yu | H01R 13/055 439/689 |
| 9,502,815 | B2 * | 11/2016 | Akiguchi | H01R 13/10 |
| 9,583,869 | B2 * | 2/2017 | Shindo | H01R 13/533 |
| 2011/0086525 | A1 * | 4/2011 | Begemann | H01R 12/57 439/83 |
| 2013/0084751 | A1 * | 4/2013 | Shindo | H01R 13/6315 439/626 |
| 2015/0044889 | A1 * | 2/2015 | Wang | H01R 12/707 439/83 |
| 2015/0070557 | A1 * | 3/2015 | Petty | H04N 5/2251 348/333.01 |
| 2015/0111419 | A1 * | 4/2015 | Komiyama | H01R 13/11 439/510 |

FOREIGN PATENT DOCUMENTS

| | | | | |
|---|---|---|---|---|
| JP | 2012-146918 | A | 8/2012 | |
| JP | 2013-115139 | A | 6/2013 | |
| JP | 2014-010949 | A | 1/2014 | |
| WO | WO 2014002389 | A1 * | 1/2014 | H01R 13/11 |

* cited by examiner

ELECTRICAL CONNECTOR AND METHOD FOR MOUNTING ELECTRICAL CONNECTOR ON CIRCUIT BOARD

CROSS-REFERENCE TO RELATED APPLICATION

The present application claims priority to Japanese Patent Application No. JP 2015-084997 filed on Apr. 17, 2015, which is incorporated herein by reference in its entirety.

BACKGROUND OF THE INVENTION

Field of the Invention

The present invention relates to an electrical connector to be mounted on a circuit board, and a method for mounting the electrical connector on a circuit board.

Description of the Background Art

Electrical connectors to be mounted on circuit boards through reflow soldering are disclosed in, for example, Patent Literature 1 (Japanese Laid-Open Patent Publication No. 2000-067963) and Patent Literature 2 (Japanese Laid-Open Patent Publication No. 2012-146918).

When installing such electrical connector-mounted circuit boards at locations that are frequently subjected to vibration (e.g., electric systems in automobiles, etc.), a foreign matter or the like in an electrical connector may conceivably move because of the vibration and get caught between connection terminals to cause bad contact. Thus, in order to suppress contamination of foreign matters inside electrical connectors, an electrical connector adopting a structure in which a connection terminal is covered with a housing and a lid (cap) is disclosed in, for example, Patent Literature 3 (Japanese Laid-Open Patent Publication No. 2014-010949).

With the structure of the electrical connector using the housing and the lid disclosed in Patent Literature 3, an advantageous effect of suppressing contamination of foreign matters inside the electrical connector after being mounted on a circuit board can be exerted. In addition, the electrical connector disclosed in Patent Literature 3 enables reflow soldering in a state in which the lid is fitted into the housing. As a result, the electrical connector disclosed in Patent Literature 3 also has an advantageous effect of preventing attachment of foreign matters to a connection terminal and contamination of foreign matters inside an electrical connector during reflow soldering.

In addition, when the structure of the electrical connector disclosed in Patent Literature 3 is used, the lid is fitted into the housing before conducting reflow soldering. As a result, since an operation of fitting the lid is unnecessary during a step of connecting an external component to an electrical connector-mounted circuit board obtained after the soldering, an advantageous effect regarding improvement in productivity is also obtained.

However, in the structure of the electrical connector disclosed in Patent Literature 3 described above having a male terminal whose one end is connected to a circuit board, the other end side thereof and a female terminal connected to the male terminal are completely covered by the housing and the lid. Thus, when reflow soldering the electrical connector disclosed in Patent Literature 3 to the circuit board, the female terminal and the other end side of the male terminal may conceivably not be heated to sufficient temperatures because of heated air generated during reflow not suitably circulating thereto. When the temperatures of these components are not increased sufficiently, heat of the one end of the male terminal is taken away by the female terminal and the other end side of the male terminal, and the temperature of the one end of the male terminal decreases.

When the temperature of the one end of the male terminal is low, increase in temperature of solder on the circuit board where the one end of the male terminal makes contact is affected, and heating of the solder may become insufficient. When heating of the solder becomes insufficient, phenomena such as, for example, the solder not sufficiently melting occur, and the performance of soldering the one end of the male terminal to the circuit board deteriorates.

SUMMARY OF THE INVENTION

The present invention has been made in view of the above described problem, and an object of the present invention is to provide, in a case in which reflow soldering is to be performed in a state in which a lid is fitted into a housing, an electrical connector enabling improvement in the performance of soldering a connection terminal to a circuit board, and a circuit board mounting method for the electrical connector.

A first aspect of the invention described in the present disclosure for solving the above described problem is an electrical connector that is to be mounted on a circuit board and that includes: a first connection terminal whose one end is to be electrically connected with the circuit board; a housing that is configured to support the first connection terminal in a state in which the other end of the first connection terminal is surrounded by lateral walls and disposed inside the housing, and has an opening toward an upper part opposite to a bottom part where the housing makes contact with the circuit board; a second connection terminal whose one end is to be electrically connected to the other end of the first connection terminal and whose other end is to be electrically connected to an external connection terminal which is to be inserted in the electrical connector; a lid configured to engage the opening of the housing and cover the other end of the first connection terminal and the second connection terminal. The lid has a penetration hole configured to ventilate the housing.

In the electrical connector according to the first aspect of the invention, the penetration hole for ventilating the housing is formed on the lid. Thus, even when reflow soldering is used when mounting, to the circuit board, the electrical connector in a state in which the lid is engaged with the opening of the housing; heated air generated during reflow can be caused to hit the first connection terminal and/or the second connection terminal via the penetration hole. With this, suppression of decrease, or assistance of increase, in temperature of the first connection terminal during reflow can be conducted, indirectly or directly. Thus, by suppressing insufficient heating of the solder, the performance of soldering the first connection terminal of the electrical connector to the circuit board can be improved.

In a second aspect of the invention described in the present disclosure based on the electrical connector of the first aspect of the invention, when the penetration hole is parallelly projected in a direction perpendicular with respect to the upper part of the lid, a projection shape of the penetration hole is formed at a position that overlaps the second connection terminal.

In the electrical connector according to the second aspect of the invention, the penetration hole is formed such that the projection shape of the penetration hole is formed at a position that overlaps the second connection terminal. Thus, during reflow soldering, heated air generated during reflow and entering through the penetration hole directly hits the second connection terminal. As a result, since the temperature of the second connection terminal can be increased quickly, indirectly suppressing decrease, or assisting increase, in temperature of the first connection terminal becomes possible.

In a third aspect of the invention described in the present disclosure based on the electrical connector of the first aspect of the invention, when the penetration hole is parallelly projected in a direction perpendicular with respect to the upper part of the lid, a projection shape of the penetration hole is formed at a position that overlaps the first connection terminal.

In the electrical connector according to the third aspect of the invention, the penetration hole is formed such that the projection shape of the penetration hole is formed at a position that overlaps the first connection terminal. Thus, during reflow soldering, heated air generated during reflow and entering through the penetration hole directly hits the first connection terminal. As a result, directly suppressing decrease, or assisting increase, in temperature of the first connection terminal becomes possible.

In a fourth aspect of the invention described in the present disclosure, the electrical connector based on the first aspect of the invention includes a plurality of the first connection terminals, and the lid has a plurality of the penetration holes corresponding to the plurality of the first connection terminals and configured to ventilate the housing.

In the electrical connector according to the fourth aspect of the invention, a penetration hole is formed for each of the plurality of the first connection terminals. With this, each of the plurality of the first connection terminals is effectively heated by heated air generated during reflow and entering through a corresponding penetration hole. As a result, the performance of soldering each of the first connection terminals of the electrical connector to the circuit board can be improved, individually.

In a fifth aspect of the invention described in the present disclosure based on the electrical connector according to the second or third aspect of the invention, the penetration hole has a forward tapered shape in which an opening size of the housing becomes smaller from outside toward inside of the housing.

In the electrical connector according to the fifth aspect of the invention, the shape of the penetration hole is a forward tapered shape in which an inlet for the heated air generated during reflow is wide and an exit for the heated air is tapered. As a result, the heated air generated during reflow can hit the first or second connection terminal with more certainty.

In a sixth aspect of the invention described in the present disclosure based on the electrical connector according to the second or third aspect of the invention, the penetration hole is formed of multiple holes, and each of the multiple holes has a forward tapered shape in which an opening size of the housing becomes smaller from outside toward inside of the housing.

In the electrical connector according to the sixth aspect of the invention, the penetration hole is formed of multiple holes, and the shape of each of the holes is a forward tapered shape in which an inlet for the heated air generated during reflow is wide and an exit for the heated air is tapered. As a result, a flow-streamlining function is provided by the penetration hole, and the heated air generated during reflow can hit the first or second connection terminal with more certainty.

A seventh aspect of the invention described in the present disclosure is a method of mounting an electrical connector on a circuit board and connecting the electrical connector to an external component. The electrical connector includes: a first connection terminal whose one end is to be electrically connected with the circuit board; a housing that is configured to support the first connection terminal in a state in which the other end of the first connection terminal is surrounded by lateral walls and disposed inside the housing, that has an opening toward an upper part opposite to a bottom part where the housing makes contact with the circuit board, and that has a first penetration hole on at least one of the lateral walls; a second connection terminal whose one end is to be electrically connected to the other end of the first connection terminal and whose other end is to be electrically connected to an external connection terminal of an external component which is to be inserted in the electrical connector; and a lid that has a second penetration hole and is configured to engage the opening of the housing and cover the other end of the first connection terminal and the second connection terminal. The method includes: causing the lid to engage the opening of the housing to an intermediate position where the first penetration hole is not blocked; placing the electrical connector on the circuit board such that the bottom part of the housing, with which the lid is engaged to the intermediate position, is positioned toward the circuit board; electrically connecting, in a state in which a ventilation pathway is formed from the second penetration hole to the first penetration hole, the one end of the first connection terminal to the circuit board by conducting reflow soldering on the electrical connector placed on the circuit board; connecting the other end of the second connection terminal to the external connection terminal of the external component inserted in the electrical connector; and causing, after the other end of the second connection terminal and the external connection terminal of the external component are connected, further engagement of the lid that had been engaged to the intermediate position and closing the first penetration hole.

In the method of mounting the electrical connector on the circuit board and connecting the electrical connector to an external component according to the seventh aspect of the invention, reflow soldering is conducted with respect to the electrical connector in a state (semi-assembled state) in which an enter/discharge pathway for the heated air is formed by the second penetration hole provided on the lid and the first penetration hole provided on the housing. With this, most of the heated air generated during reflow can be caused to enter from the second penetration hole, hit the first connection terminal and/or the second connection terminal, and exit from the first penetration hole. As a result, suppression of decrease, or assistance of increase, in temperature of the first connection terminal during reflow and can be conducted, indirectly or directly. Thus, by suppressing insufficient heating of the solder, the performance of soldering the first connection terminal of the electrical connector to the circuit board can be improved. Since the first penetration hole closes after the first connection terminal is soldered to the circuit board, contamination of foreign matters from the first penetration hole can be prevented.

As described above, with the electrical connector and the circuit board mounting method for the electrical connector of the present invention, in a case in which reflow soldering is to be performed in a state in which a lid is fitted into a housing, the performance of soldering a connection terminal to a circuit board can be improved.

These and other objects, features, aspects and advantages of the present invention will become more apparent from the following detailed description of the present invention when taken in conjunction with the accompanying drawings.

DESCRIPTION OF THE PREFERRED EMBODIMENTS

[General Outline]

An electrical connector of the present invention has, on a lid that is to be fitted into a housing that surrounds a connection terminal, a penetration hole for ventilating the housing. With this, when mounting the electrical connector having the lid fitted thereon on a circuit board by using reflow soldering; heated air generated during reflow can hit the connection terminal through the penetration hole. As a result, suppression of decrease, or assistance of increase, in temperature of the connection terminal during reflow can be conducted, indirectly or directly. Thus, by suppressing insufficient heating of the solder that makes contact with the connection terminal, the performance of soldering the connection terminal to the circuit board can be improved.

In the following, embodiments of the invention will be described in detail with reference to the drawings.

First Embodiment

Figure 1A:
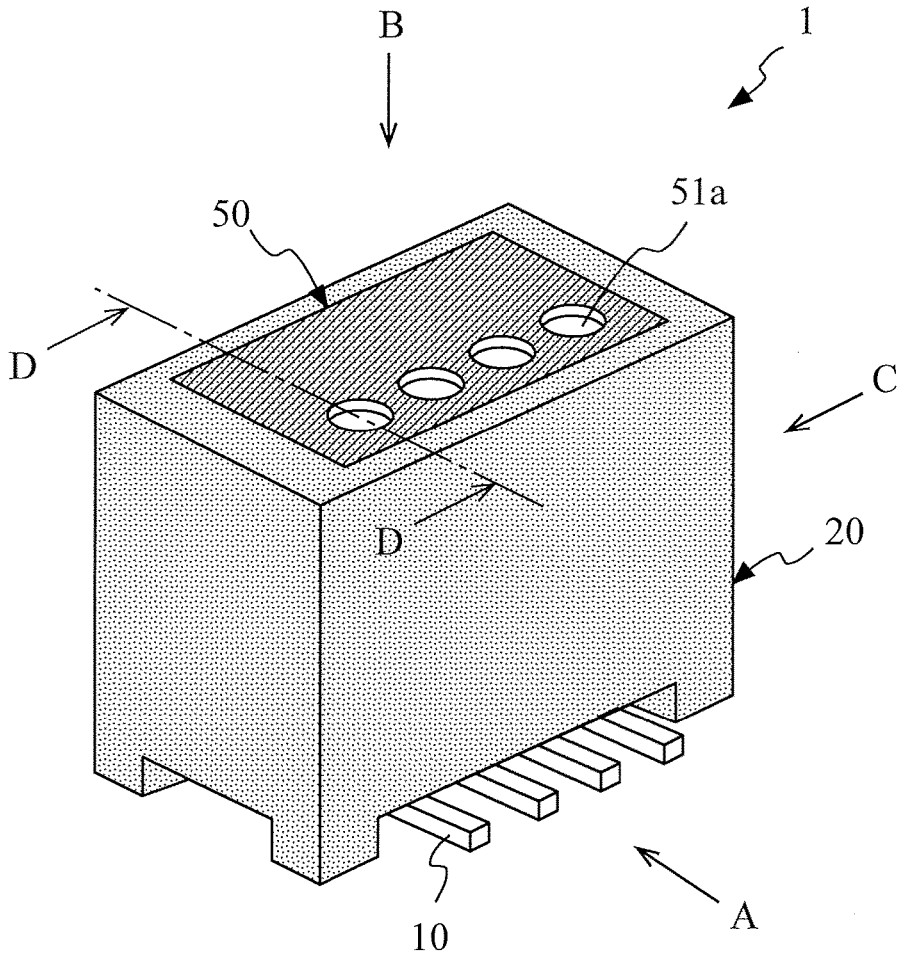
FIG. 1A is an exterior perspective view that schematically shows the configuration of an electrical connector according to a first embodiment of the present invention.
Figure 1B:
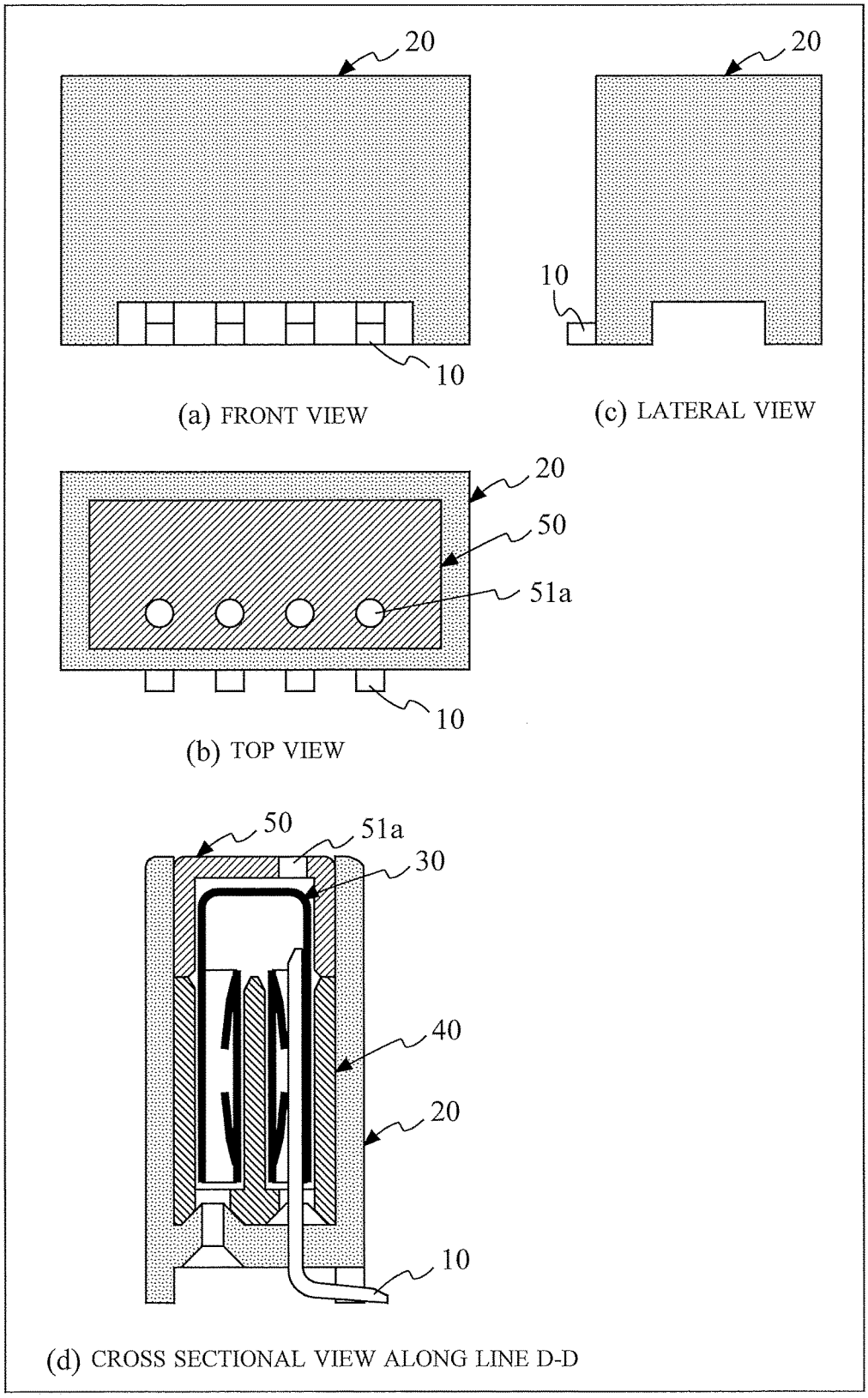
FIG. 1B shows a front view, a top view, a lateral view, and a cross sectional view along a certain line for the electrical connector according to the first embodiment.
Figure 2:
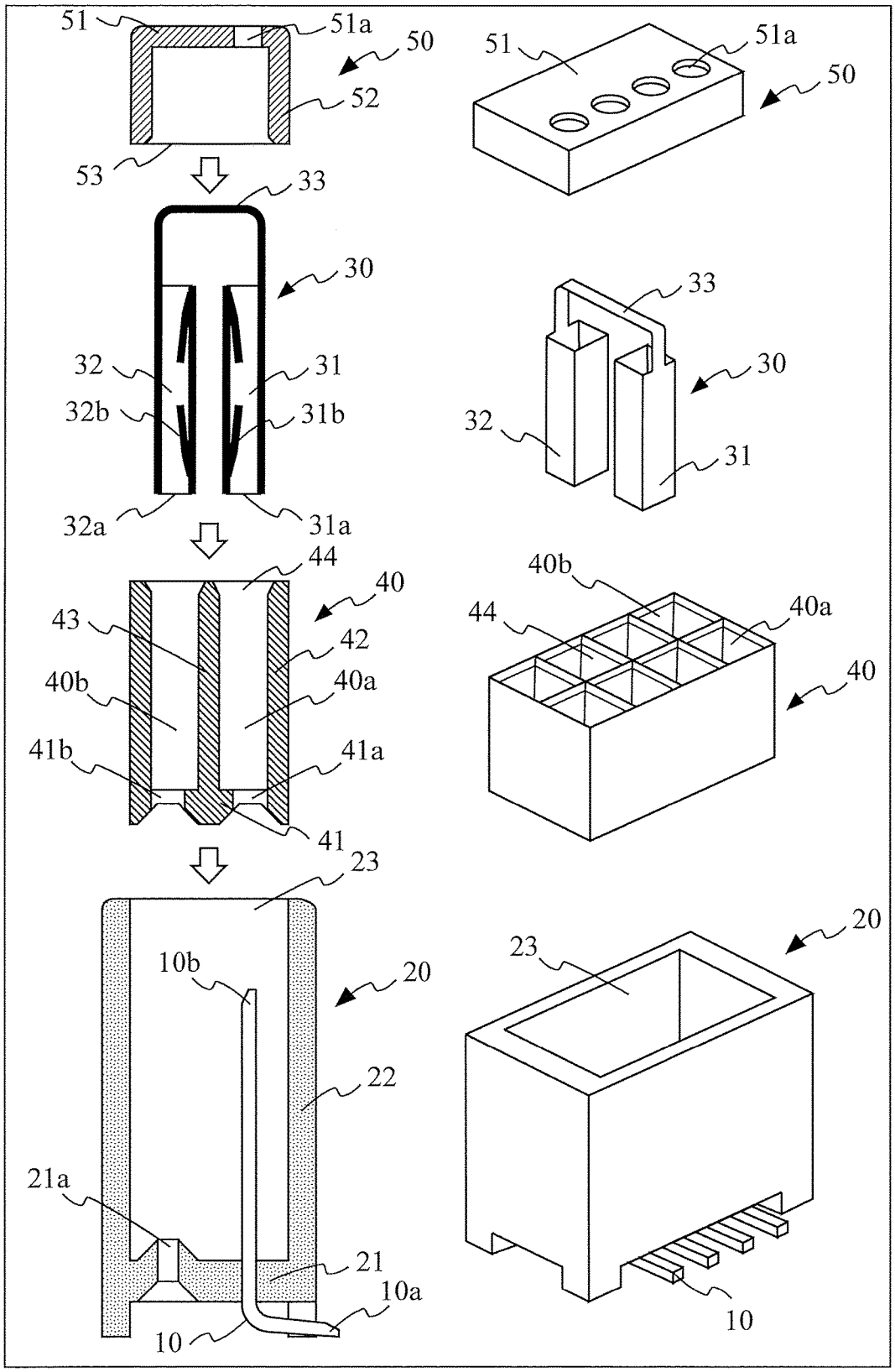
FIG. 2 shows diagrammatic perspective views and assembled views of each component forming the electrical connector according to the first embodiment.

The configuration of an electrical connector according to a first embodiment of the present invention will be described. FIG. 1A is an exterior perspective view that schematically shows the configuration of an electrical connector 1 according to the first embodiment of the present invention. FIG. 1B shows: (a) a front view as viewed from direction A, (b) a top view as viewed from direction B, (c) a lateral view as viewed from direction C, and (d) a cross sectional view along line D-D, for the electrical connector 1 shown in FIG. 1A. FIG. 2 shows diagrammatic perspective views and assembled views of each component forming the electrical connector 1 according to the first embodiment. In each of the figures, component parts that are basically the same are provided with the same shading pattern in order to easily distinguish the component parts.

[Configuration of Electrical Connector]

As shown in FIGS. 1A, 1B, and 2; the electrical connector 1 according to the first embodiment is formed so as to include first connection terminals 10, a housing 20, second connection terminals 30, a terminal holding part 40, and a lid 50. The present electrical connector 1 is mounted on a circuit board (described later), and is a component that electrically connects, for example, a predetermined terminal (point) on the surface of the circuit board and a predetermined terminal of a component disposed on the back surface side of the circuit board via a through-hole of the circuit board.

The first connection terminals 10 are supported by the housing 20. The second connection terminals 30 are housed in the terminal holding part 40. The terminal holding part 40 in which the second connection terminals 30 are housed is fitted into the housing 20 that supports the first connection terminals 10. An upper part of the housing 20 into which the terminal holding part 40 is fitted is covered by the lid 50. With this, the electrical connector 1 is formed. In the following, each of the components of the electrical connector 1 will be described, firstly.

First Connection Terminal 10

The first connection terminals 10 are each an electrical connection terminal formed of a metallic member or the like that is electrically conductive. One end 10*a* of each of the first connection terminals 10 is electrically connected by soldering to a predetermined terminal (point) of the circuit board on which the electrical connector 1 is mounted. The other end 10*b* of each of the first connection terminals 10 is connected to a first connection part 31 (described later) of each of the second connection terminals 30. Each of the first connection terminals 10 exemplified in the first embodiment is a male terminal (e.g., see FIG. 2) having approximately a shape of a letter "L" obtained by bending a bar shaped member at a position, such that a linear portion on a side of the other end 10*b* becomes longer than a side of the one end 10*a*.

The number of the first connection terminals 10 is not limited to four as diagrammatically represented, and may be not larger than three or not smaller than five. In addition, the shape of each of the first connection terminals 10 may be a shape other than the letter "L" shape that is diagrammatically represented, or may be a female terminal shape. The housing 20, the second connection terminals 30, the terminal holding part 40, and the lid 50 may be modified as appropriate depending on the number and the shapes of the first connection terminals 10.

Housing 20

The housing 20 is formed from a resin material that is electrically non-conductive. As can be understood from FIG. 2, the housing 20 is a substantially box shaped component formed from a bottom part (floor board) 21 which becomes a side (that opposes the circuit board) that makes contact with the circuit board, and four lateral walls 22 that make contact with the rim of the bottom part 21. An insertion hole 21*a* through which an external connection terminal (described later) is inserted is formed on the bottom part 21. The insertion hole 21*a* has a hole-diameter that is larger than an outer circumference diameter of the external connection terminal, and an insertion opening for the external connection terminal is provided with a forward tapered shape in which the opening size becomes smaller in the insertion direction. An opening 23 is formed on the upper part located opposite to the bottom part 21. The housing 20 fixedly supports the first connection terminals 10 such that the one end 10*a* of each of the first connection terminals 10 is positioned outside the bottom part 21, whereas the other end 10*b* of each of the first connection terminals 10 is positioned inside the housing surrounded by the four lateral walls 22.

Second Connection Terminal 30

The second connection terminals 30 are each an electrical connection terminal formed of a metallic member or the like that is electrically conductive, and are each formed from the first connection part 31, a second connection part 32, and a linking part 33. The second connection terminals 30 are provided in accordance with the number of the first connection terminals 10 included in the electrical connector 1. In the electrical connector 1 including, in the configuration thereof, the terminal holding part 40 exemplified in FIG. 2, four of the second connection terminals 30 are provided.

For example, the first connection part 31 has a hollow cylinder shape having an opening 31*a* at one side thereof. In the example in FIG. 2, the first connection part 31 whose cross section is rectangular is shown. The first connection part 31 becomes electrically connected with a single one of the first connection terminals 10 when the single one of the first connection terminals 10 is inserted inside the cylinder from the opening 31*a*. Provided inside the cylinder of the first connection part 31 is a pressure-contact mechanism 31*b* (e.g., leaf spring) for applying pressure load against the inserted first connection terminals 10 in order to maintain an electrically connected state.

For example, the second connection part 32 has a hollow cylinder shape having an opening 32*a* at one side thereof. In the example in FIG. 2, the second connection part 32 whose cross section is rectangular is shown. The second connection part 32 becomes electrically connected with the external connection terminal when the external connection terminal is inserted inside the cylinder from the opening 32*a*. Provided inside the cylinder of the second connection part 32 is a pressure-contact mechanism 32*b* (e.g., leaf spring) for applying pressure load against inserted the external connection terminal in order to maintain an electrically connected state.

It should be noted that, in each the second connection terminals 30 according to the first embodiment, the first connection part 31 and the second connection part 32 have an identical shape in order to provide a foolproof measure. However, the connection part to which one of the first connection terminals 10 is to be connected and the connection part to which the external connection terminal is to be connected may be formed distinctively different from each other.

The linking part 33 is an elastically deformable member that links the first connection part 31 and the second connection part 32. The linking part 33 is formed from the same metallic material as the first connection part 31 and the second connection part 32, and is preferably formed integrally with the first connection part 31 and the second connection part 32. Although the linking part 33 is shown in the example in FIG. 2 as having a linear shape with a constant width, the shape of the linking part 33 is not limited thereto. For example, the shape of the linking part 33 may be a linear shape with varying width, a letter "S" shape, a pleated shape, or the like.

Terminal Holding Part 40

The terminal holding part 40 is formed from a resin material that is electrically non-conductive. The terminal holding part 40 is a substantially box shaped component formed from a bottom part (floor board) 41 which becomes a side to be inserted inside the housing 20, four lateral walls 42 that make contact with the rim of the bottom part 41, and inner walls 43 that divides, into multiple partitions, the internal area formed by the bottom part 41 and the four lateral walls 42. Openings 44 are formed on the upper surface located opposite to the bottom part 41. The inner walls 43 partition the area inside the terminal holding part 40 into first holding parts 40*a* that are each configured to house the first connection part 31 of each of the second connection terminals 30, and second holding parts 40*b* that are each configured to house the second connection part 32 of each of the second connection terminals 30. The first holding parts 40*a* and the second holding parts 40*b* are both formed in a total number equal to the second connection terminals 30. Thus, in the example in FIG. 2, the area inside the terminal holding part 40 is divided into eight partitions, i.e., four of the first holding parts 40*a* and four of the second holding parts 40*b*.

Insertion holes 41*a* through which the first connection terminals 10 are inserted are formed at parts of the bottom part 41 where the first holding parts 40*a* are located. In addition, insertion holes 41*b* through which the external connection terminal is inserted are formed at parts of the bottom part 41 where the second holding parts 40*b* are located. The insertion holes 41*a* have a hole-diameter that is larger than the outer circumference diameter of the first connection terminals 10, and an insertion opening on the other end 10*b* of each of the first connection terminals 10 is provided with a forward tapered shape in which the opening size becomes smaller in the insertion direction. In addition, the insertion holes 41*b* have a hole-diameter that is larger than the outer circumference diameter of the external connection terminal, and an insertion opening for the external connection terminal is provided with a forward tapered shape in which the opening size becomes smaller in the insertion direction.

It should be noted that, in the terminal holding part 40 according to the first embodiment, the first holding parts 40*a* and the second holding parts 40*b* have an identical shape in order to provide a foolproof measure. However, the holding part in which the first connection part 31 of each of the second connection terminals 30 is to be housed and the holding part in which the second connection part 32 of each of the second connection terminals 30 is to be housed may be formed distinctively different from each other.

Lid 50

The lid 50 is formed from a resin material that is electrically non-conductive. The lid 50 is a substantially box shaped component formed from an upper part 51, and four lateral walls 52 that make contact with the rim of the upper part 51. An opening 53 is formed on the bottom surface located opposite to the upper part 51. In addition, multiple penetration holes 51*a* are formed on the upper part 51. When the lid 50 engages the housing 20, the penetration holes 51*a* serve a role of allowing air to pass between the inside and outside of the housing 20, i.e., ventilating the housing 20. The penetration holes 51*a* are preferably formed in a quantity corresponding to the number of the first connection terminals 10.

The electrical connector 1 according to the first embodiment can effectively solve the problem set forth in the present invention since the penetration holes 51*a* for ventilating the housing 20 are formed on the upper part 51 of the lid 50. Furthermore, a highly advantageous effect can be obtained by setting a certain relationship between the penetration holes 51*a* and the second connection terminals 30 when the lid 50 engages the housing 20. The size and position of the penetration holes 51*a* based on this certain relationship will be described later.

Entire Structure of Electrical Connector

Next, the entire structure of the electrical connector 1 formed from the first connection terminals 10, the housing 20, the second connection terminals 30, the terminal holding part 40, and the lid 50 described above will be described in detail.

The second connection terminals 30 are housed in the terminal holding part 40. At this moment, one of the first holding parts 40*a* and one of the second holding parts 40*b* adjacent thereto in the terminal holding part 40 act as a single pair, and the second connection terminals 30 are inserted in the openings 44 of the terminal holding part 40 from the side of the openings 31*a* and 32*a*. As a result, the first connection part 31 of each of the second connection terminals 30 and the second connection part 32 of each of the second connection terminals 30 are respectively housed in one of the first holding parts 40*a* of the terminal holding part 40 and one of the second holding parts 40*b* of the terminal holding part 40. In the first embodiment, four of the second connection terminals 30 are housed with respect to the terminal holding part 40 having eight partitions therein.

The terminal holding part 40 in which the second connection terminals 30 are housed is fitted inside the housing 20 including the first connection terminals 10. At this moment, the terminal holding part 40 is fitted inside the housing 20 in a state in which the other end 10*b* of each of the first connection terminals 10 is inserted from a single one of the insertion holes 41*a* of the terminal holding part 40. With this, each of the first connection terminals 10 is electrically connected to the first connection part 31 of each of the second connection terminals 30 housed in each of the first holding parts 40*a* of the terminal holding part 40. Needless to mention that when the foolproof measure is implemented for the second connection terminals 30 and the terminal holding part 40 as described above, the terminal holding part 40 may be fitted inside the housing 20 in the state in which the other end 10*b* of each of the first connection terminals 10 is inserted from a single one of the insertion holes 41*b* of the terminal holding part 40.

The lid 50 is fitted into the upper part of the housing 20 into which the terminal holding part 40 housing the second connection terminal 30 is fitted. In a state in which the lid 50 is fitted into the housing 20, the following specific relationship exists between the second connection terminal 30 and the penetration holes 51*a* formed on the upper part 51 of the lid 50.

Figure 3:
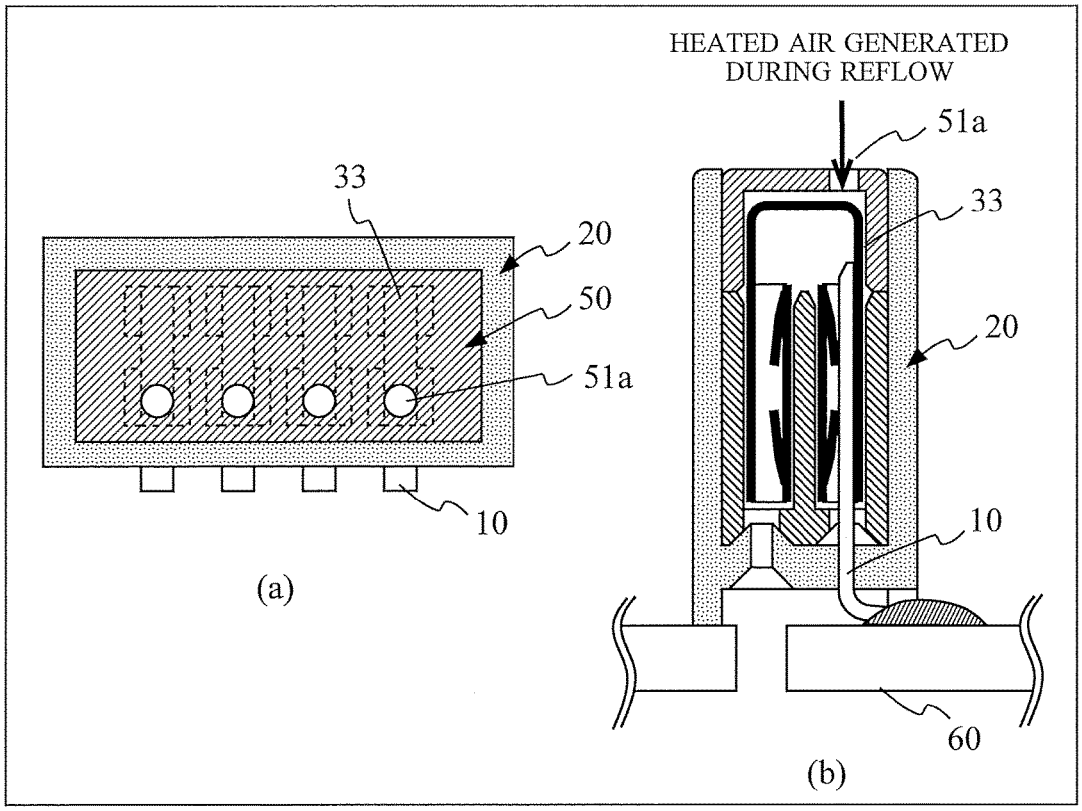
FIG. 3 is for describing one example of the size and position of a penetration hole formed on a lid.

The size and position of the penetration holes 51*a* are set such that the relationship between the penetration holes 51*a* and the second connection terminals 30 is one in which, when the penetration holes 51*a* are parallelly projected in a direction perpendicular with respect to the upper part 51, a projection shape of each of the penetration holes 51*a* overlaps the linking part 33 of each of the second connection terminals 30 (e.g., (a) of FIG. 3). Here, the projection shape of each of the penetration holes 51*a* and the linking part 33 of each of the second connection terminals 30 may completely overlap or may partially overlap. The object with which the projection shape overlaps may be the first connection part 31 instead of the linking part 33. Furthermore, when the penetration holes 51*a* are parallelly projected in a direction perpendicular with respect to the upper part 51, the relationship may be one in which the projection shape of each of the penetration holes 51*a* overlaps the other end 10*b* of the first connection terminals 10.

Here, "the projection shape of each of the penetration holes 51*a* overlaps the linking part 33 of each of the second connection terminals 30" means that, during reflow soldering conducted in a later described circuit board mounting step for the electrical connector 1, the heated air generated during reflow passes through the penetration holes 51*a* and directly hits the linking part 33 of each of the second connection terminals 30. More specifically, it means that there is no obstructing object between the penetration holes 51*a* and the linking part 33 of each of the second connection terminals 30.

It should be noted that, for practical use, locking mechanisms such as a locking mechanism for retaining the second connection terminals 30 in the terminal holding part 40 so as to not fall out therefrom easily, a locking mechanism for retaining the terminal holding part 40 in the housing 20 so as to not fall out therefrom easily, and a locking mechanism for retaining the lid 50 in the housing 20 so as to not disengage therefrom easily, are included. However, since these locking mechanisms are not an essence of the present invention, diagrammatic representation and description thereof are omitted in the embodiment.

[Circuit Board Mounting Method for Electrical Connector]

Mounting of the electrical connector 1 according to the first embodiment with respect to a circuit board is performed as described next, for example. Housing and engaging of the first connection terminals 10, the housing 20, the second connection terminals 30, the terminal holding part 40, and the lid 50 are performed with a predetermined procedure to assemble the electrical connector 1. A circuit board 60 having disposed thereon a solder for reflow is prepared. The assembled electrical connector 1 is placed at a position where the first connection terminals 10 make contact with predetermined terminals (points) on the circuit board. With respect to the circuit board having the electrical connector 1 placed thereon, reflow soldering is conducted to electrically connect the first connection terminals 10 and the circuit board.

During reflow soldering, part of the heated air that hits the upper part 51 of the lid 50 from above the circuit board 60 passes through the penetration holes 51*a* on the lid 50 and hits the linking part 33 of each of the second connection terminals 30 (see (b) of FIG. 3). As a result, the temperature of the linking part 33 of each of the second connection terminals 30 quickly rises because of the heated air directly hitting the linking part 33, and, associated with the temperature rise, the temperature of the first connection part 31 linked to the linking part 33 also rises. Heat of the first connection part 31 of each of the second connection terminals 30 is transferred to the first connection terminals 10 in contact with the first connection part 31. The heated air, which has entered inside the housing 20 from the penetration holes 51*a*, hits the linking part 33 of each of the second connection terminals 30, and is subsequently discharged outside the housing 20 from such as the insertion hole 21*a* formed on the bottom part 21 of the housing 20, for example.

Thus, when compared to a case where the heated air generated during reflow not hitting the second connection terminals 30, the phenomenon in which heat of the one end 10*a* of each of the first connection terminals 10 is taken away by each of the second connection terminals 30 to cause the temperature of the first connection terminals 10 to decrease can be suppressed. In addition, since the temperature of the second connection terminals 30 is transferred to the first connection terminals 10 when the temperature of the second connection terminals 30 is higher than the temperature of the first connection terminals 10; the temperature of the first connection terminals 10 further increases. As a result, the performance of soldering the first connection terminals 10 to the circuit board 60 improves.

Needless to mention that when part of the heated air that hits the upper part 51 of the lid 50 from above the circuit board 60 passes through the penetration holes 51*a* on the lid 50 and directly hits the other end 10*b* of each of the first connection terminals 10, the temperature of the first connection terminals 10 also increases. As a result, the performance of soldering the first connection terminals 10 to the circuit board 60 improves.

[Operation/Working-Effect of Embodiment]

As described above, in the electrical connector 1 according to the first embodiment of the present invention, the penetration holes 51*a* whose projection shapes each overlap the linking part 33 of each of the second connection terminals 30 are formed on the upper part 51 of the lid 50. With this, when conducting reflow soldering in the state in which the lid 50 is fitted into the housing 20, the heated air generated during reflow can be caused to hit the linking part 33 of each of the second connection terminals 30. As a result, suppression of decrease, or assistance of increase, in temperature of the first connection terminals 10 during reflow can be conducted, indirectly or directly. Thus, by suppressing insufficient heating of the solder, the performance of soldering (the one end 10*a* of) each of the first connection terminals 10 of the electrical connector 1 to the circuit board 60 can be improved.

With the electrical connector 1 according to the first embodiment of the present invention, as a means for causing the heated air generated during reflow to hit the linking part 33 of each of the second connection terminals 30, the penetration holes 51*a* formed on the upper part 51 of the lid 50 are used instead of simply having an opening on the upper part of the connector. As a result, with the present electrical connector 1, the possibility of contamination of foreign matters inside the connector can be reduced when compared to a top-open type electrical connector in which the lid 50 is not used. In addition, the structure of the present electrical connector 1 has a pathway for the heated air generated during reflow for passing from the penetration holes 51*a* to the insertion hole 21*a*, for example. As a result, when compared to a top-open type electrical connector in which the lid 50 is not used, the present electrical connector 1 can suppress attachment of foreign matters to a connection terminal and contamination of foreign matters inside the electrical connector during reflow soldering.

In addition, with the electrical connector 1 according to the first embodiment of the present invention, since reflow soldering is conducted in the state in which the lid 50 is fitted into the housing 20, productivity can be maintained at a level similar to conventional levels.

[Modification]

Figure 4:
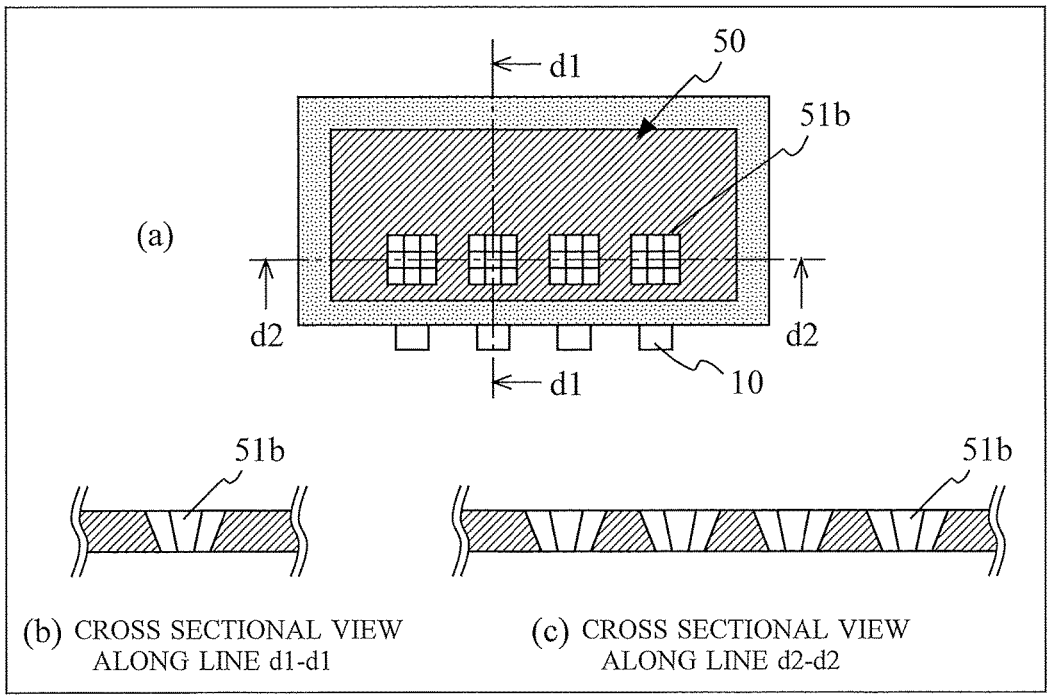
FIG. 4 is for describing a modification of the penetration hole formed on the lid.

In the example described above, although a case has been described in which the shape of the penetration holes 51*a* formed on the upper part 51 of the lid 50 is circular; the shape may be other than circular such as rectangular, elliptical, or oval. In addition, the penetration holes 51*a* may be tapered, or each of the penetration holes 51*a* may be formed from multiple holes. For example, penetration holes 51*b* as shown in FIG. 4 may be formed. Each of the penetration holes 51*b* is formed from multiple holes, and each of the holes is provided with a forward tapered shape in which the opening size becomes smaller in a direction from the upper part 51 of the lid 50 toward the opening 53. By having this shape, the penetration holes 51*b* provide a flow-streamlining function. When the penetration holes 51*b* having the flow-streamlining function is formed, the heated air that is generated during reflow and that passes through the penetration holes 51*b* can be caused to efficiently hit the linking part 33 of each of the second connection terminals 30.

Second Embodiment

Figure 5A:
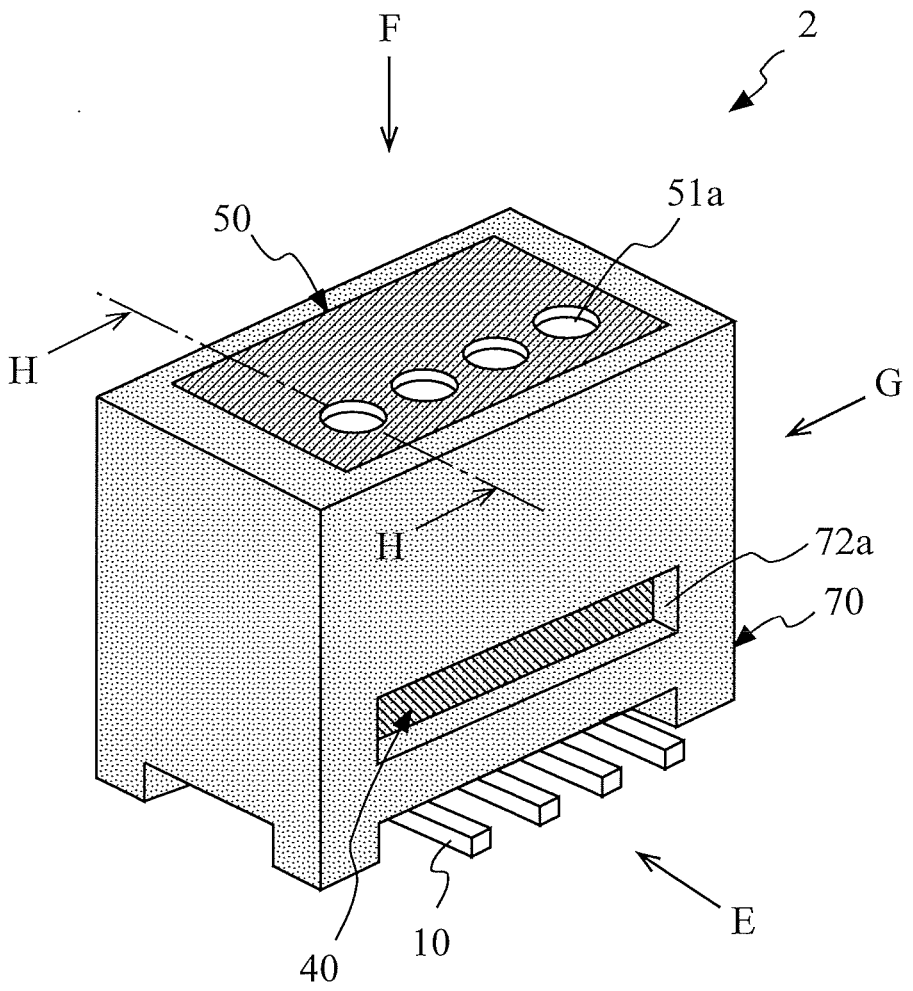
FIG. 5A is an exterior perspective view that schematically shows the configuration of electrical connector according to a second embodiment of the present invention.
Figure 5B:
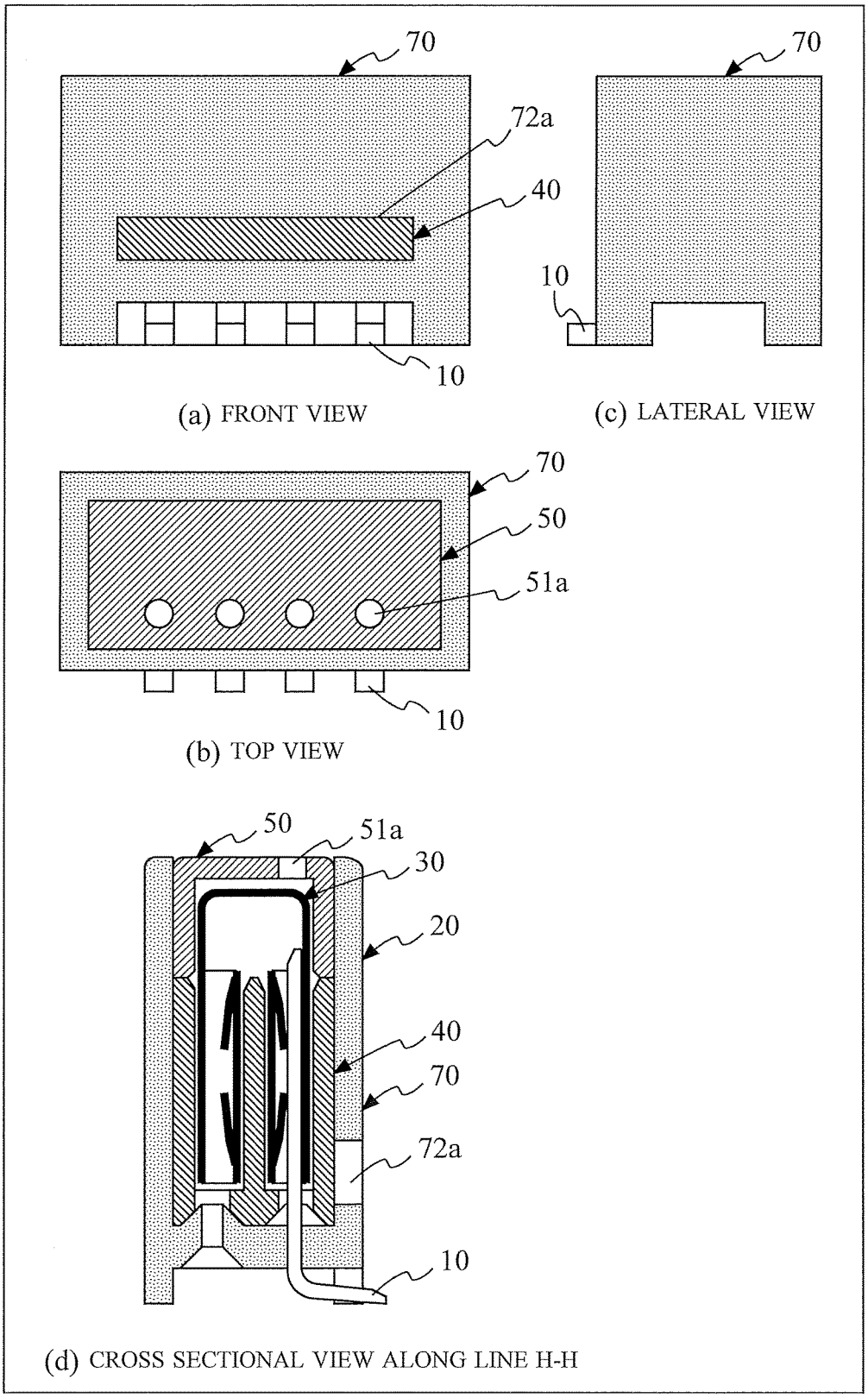
FIG. 5B shows a front view, a top view, a lateral view, and a cross sectional view along a certain line for the electrical connector according to the second embodiment.
Figure 6:
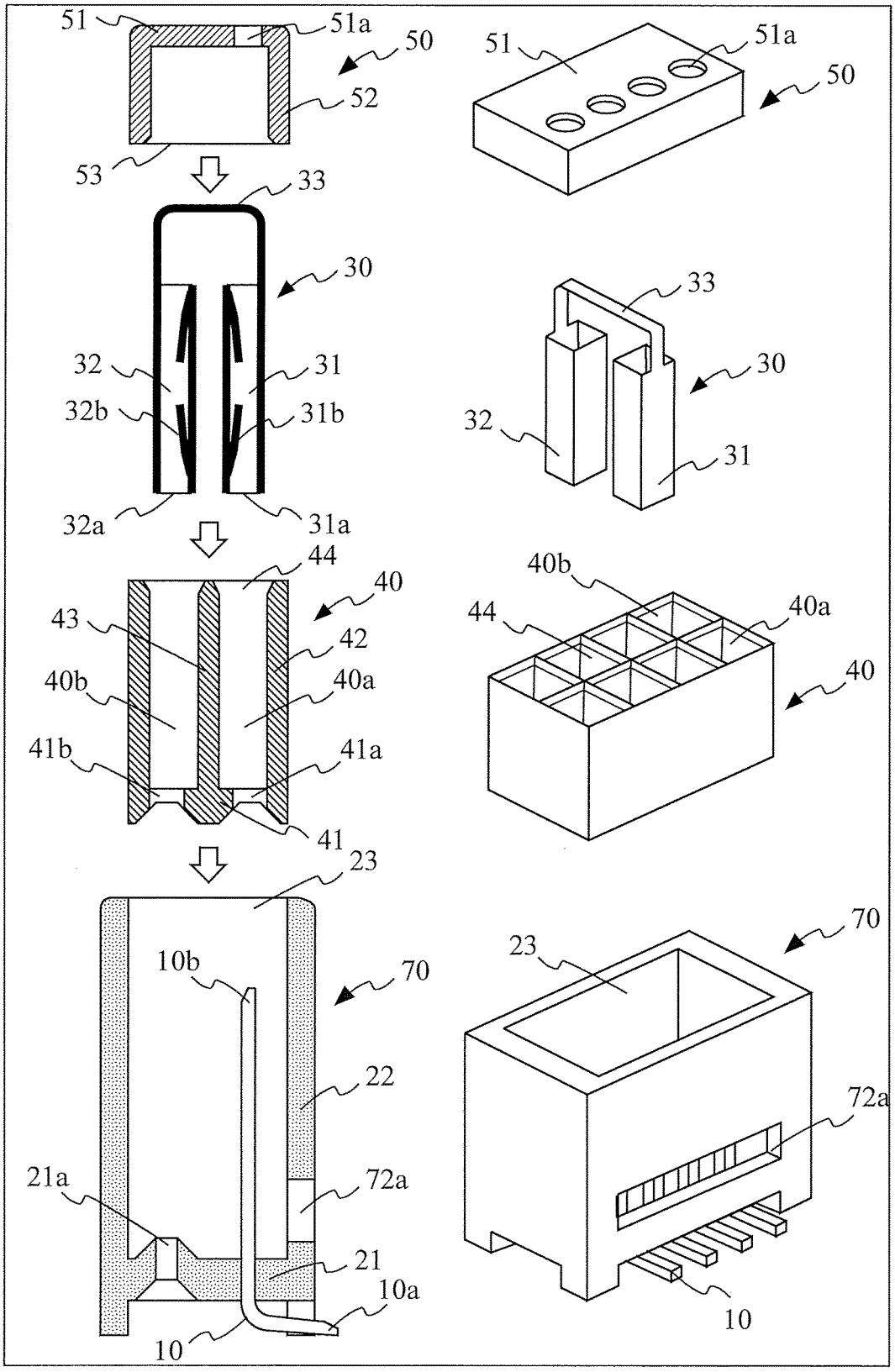
FIG. 6 shows diagrammatic perspective views and assembled views of each component forming the electrical connector according to the second embodiment.

The configuration of an electrical connector according to a second embodiment of the present invention will be described. FIG. 5A is an exterior perspective view that schematically shows the configuration of an electrical connector 2 according to the second embodiment of the present invention. FIG. 5B shows: (a) a front view as viewed from direction E, (b) a top view as viewed from direction F, (c) a lateral view as viewed from direction G, and (d) a cross sectional view along line H-H, for the electrical connector 2 shown in FIG. 5A. FIG. 6 shows diagrammatic perspective views and assembled views of each component forming the electrical connector 2 according to the second embodiment. In each of the figures, component parts that are basically the same are provided with the same shading pattern in order to easily distinguish the component parts.

[Configuration of Electrical Connector]

As shown in FIGS. 5A, 5B, and 6; the electrical connector 2 according to the second embodiment is formed so as to include the first connection terminals 10, a housing 70, the second connection terminals 30, the terminal holding part 40, and the lid 50. The electrical connector 2 according to the second embodiment differs from the electrical connector 1 according to the first embodiment only in the configuration of the housing 70. The procedure for assembling the electrical connector 2 according to the second embodiment is similar to that for the electrical connector 1 according to the first embodiment except for the difference in reference characters for the housing 70.

In the following, the electrical connector 2 according to the second embodiment will be described mainly regarding the housing 70, and other components in the electrical connector 2 are given the same reference characters as in the electrical connector 1 according to the first embodiment and description thereof is omitted.

Housing 70

The housing 70 is formed from a resin material that is electrically non-conductive. As can be understood from FIG. 6, the housing 70 is a substantially box shaped component formed from the bottom part (floor board) 21 which becomes a side that makes contact with the circuit board (opposes the circuit board), and the four lateral walls 22 that make contact with the rim of the bottom part 21. The insertion hole 21*a* through which an external connection terminal (described later) is inserted is formed on the bottom part 21. The insertion hole 21*a* has a hole-diameter that is larger than an outer circumference diameter of the external connection terminal, and an insertion opening for the external connection terminal is provided with a forward tapered shape in which the opening size becomes smaller in the insertion direction. The opening 23 is formed on an upper surface of the upper part located opposite to the bottom part 21. The housing 70 fixedly supports the first connection terminals 10 such that the one end 10*a* of each of the first connection terminals 10 is positioned outside the bottom part 21, whereas the other end 10*b* of each of the first connection terminals 10 is positioned inside the housing surrounded by the four lateral walls 22.

Furthermore, a penetration hole 72*a* is formed on at least one of the four lateral walls 22 of the housing 70. The penetration hole 72*a* is formed at a position where ventilation of the housing 70 is enabled in a state in which the terminal holding part 40 is fitted part way inside the housing 70 and is blocked in a state in which the terminal holding part 40 is completely fitted inside (or until butting) the housing 70. The second embodiment shows an example in which the penetration hole 72*a* is formed the front surface of the electrical connector 2, which is one of the lateral walls 22.

[Circuit Board Mounting Method and External Component Attachment Method for Electrical Connector]

Figure 7A:
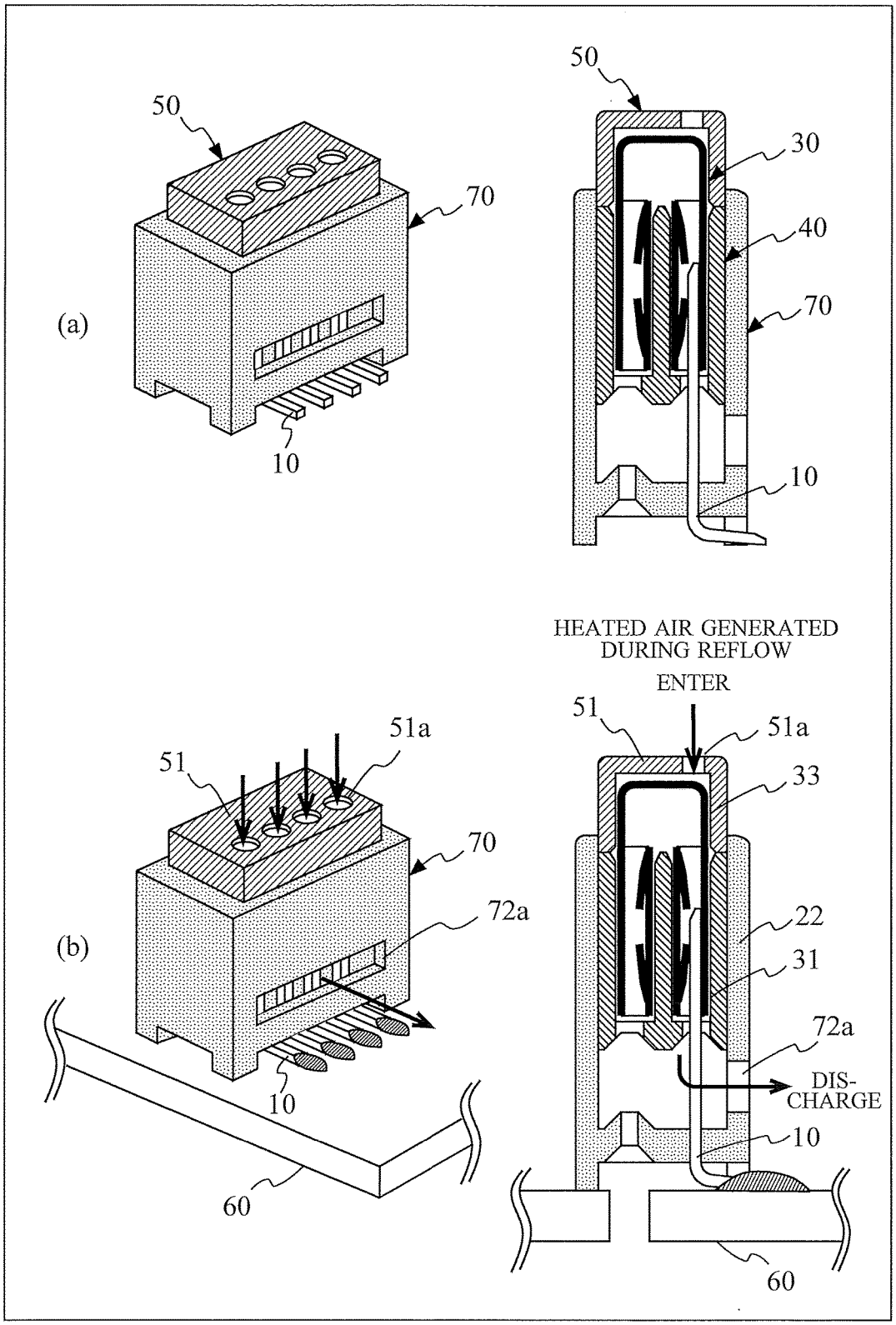
FIGS. 7A, 7B, and 7C are for describing a circuit board mounting method and an external component attaching method for the electrical connector according to the second embodiment.
Figure 7B:
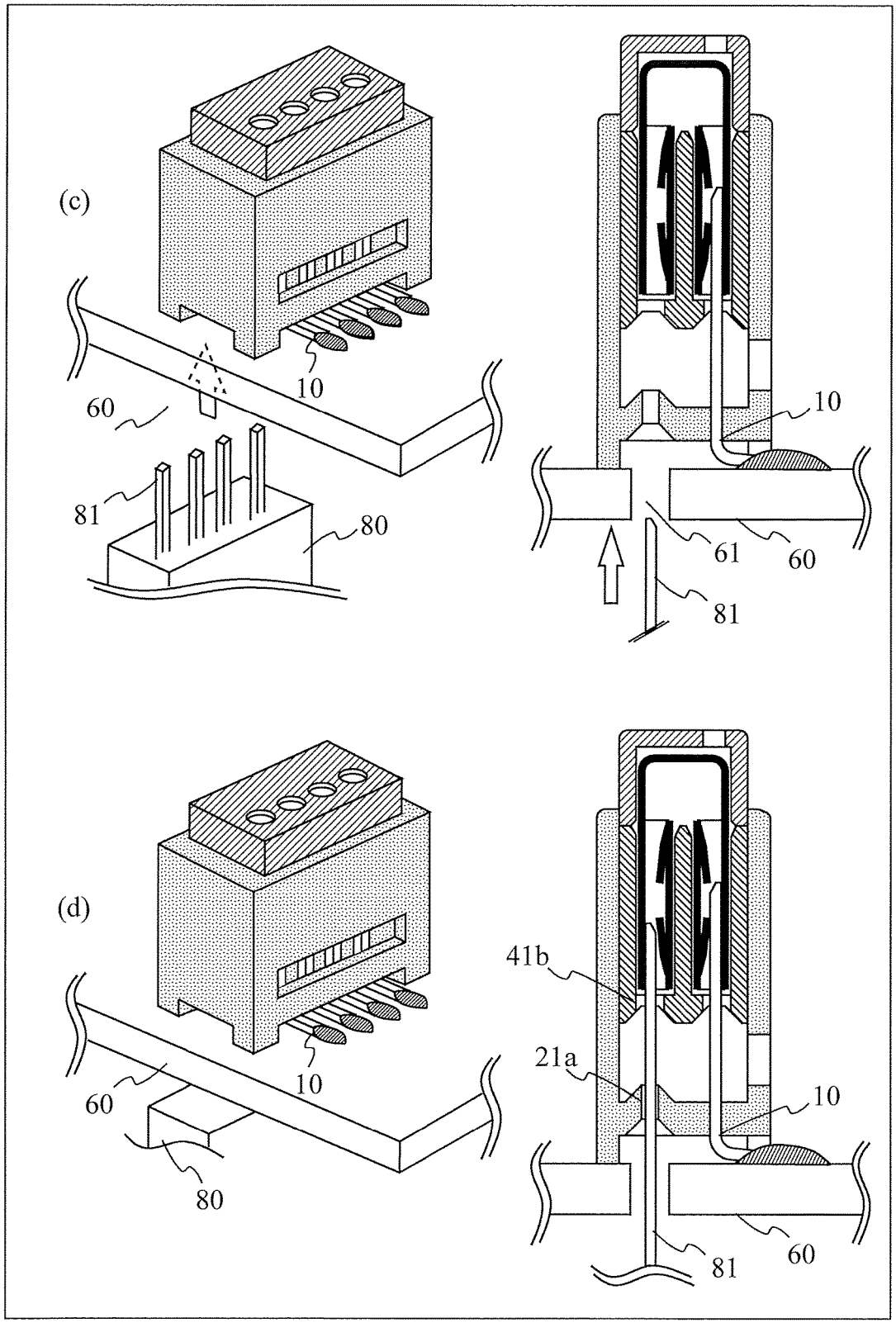
Figure 7C:
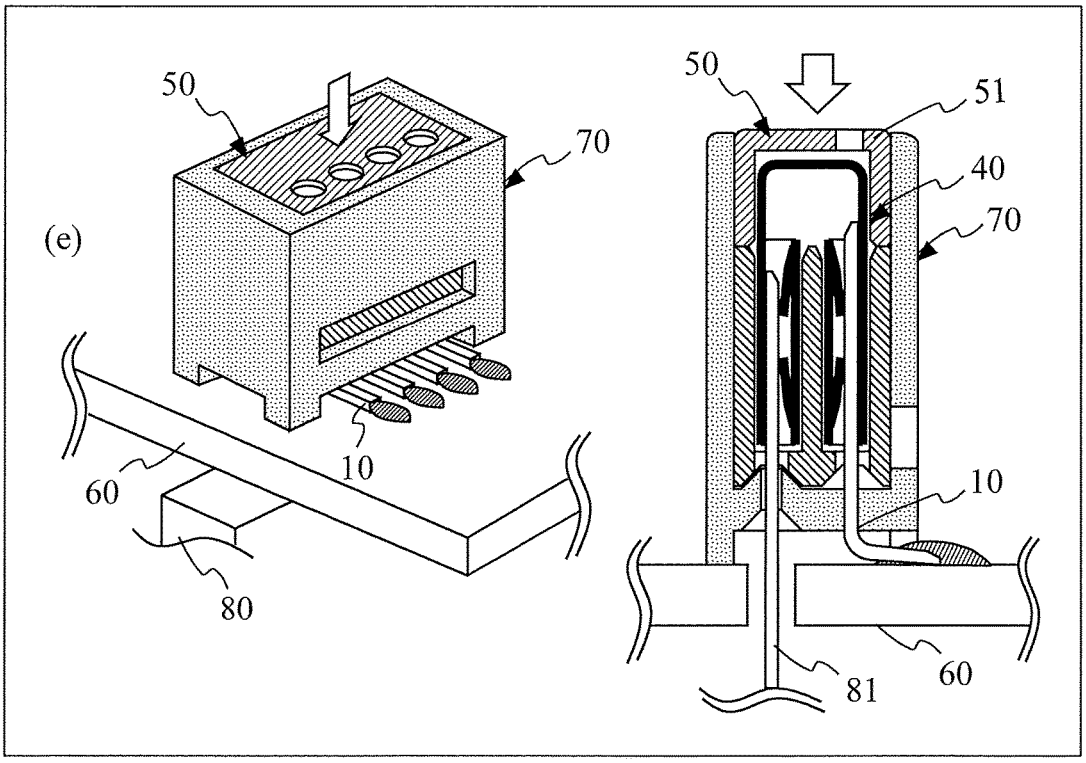

With additional reference to FIGS. 7A, 7B, and 7C; a method for mounting the electrical connector 2 according to the second embodiment to a circuit board and a method for attaching an external component to the circuit board having the electrical connector 2 mounted thereon will be described. These methods are performed as described next, for example.

The terminal holding part 40 housing the second connection terminals 30 is fitted in the housing 70 having the first connection terminals 10, to an intermediate position. The lid 50 covers the upper part of the terminal holding part 40 fitted into the intermediate position. With this, a semi-assembled state of the electrical connector 2 is obtained. See (a) of FIG. 7A.

The circuit board 60 having disposed thereon a solder for reflow is prepared. The electrical connector 2 in this semi-assembled state is placed at a position where the first connection terminals 10 make contact with predetermined terminals (points) on the circuit board 60. With respect to the circuit board 60 having the electrical connector 2 placed thereon, reflow soldering is conducted to electrically connect the first connection terminals 10 and the circuit board 60. With this, mounting of the electrical connector 2 in the semi-assembled state to the circuit board 60 is completed. See (b) of FIG. 7A.

During reflow soldering, part of the heated air that hits the upper part 51 of the lid 50 from above the circuit board 60 passes through the penetration holes 51*a* on the lid 50 and enters inside the housing 70. The heated air, which has entered inside, hits the linking part 33 of each of the second connection terminals 30, and is subsequently discharged outside the housing 70 from such as the penetration hole 72*a* formed on one of the lateral walls 22 of the housing 70 ((b) of FIG. 7A). Since an enter/discharge pathway for the heated air is formed by the penetration hole 72*a* formed on one of the lateral walls 22 of the housing 70, a large volume of the heated air can be caused to hit the linking part 33 of each of the second connection terminals 30. As a result, the temperature of the linking part 33 of each of the second connection terminals 30 quickly rises because of the heated air directly hitting the linking part 33, and, associated with the temperature rise, the temperature of the first connection part 31 linked to the linking part 33 also rises. Heat of the first connection part 31 of each of the second connection terminals 30 is transferred to the first connection terminals 10 in contact with the first connection part 31.

The circuit board 60, on which the electrical connector 2 in the semi-assembled state is mounted, is electrically connected to a certain external component 80. Specifically, an external connection terminal 81 of the external component 80 is inserted from the back side of the circuit board 60 toward the electrical connector 2 via a through-hole 61 formed on the circuit board 60. See (c) of FIG. 7B. The external connection terminal 81 of the external component 80 is inserted in the insertion hole 21*a* of the housing 20 of the electrical connector 2, and then inserted in the insertion hole 41*b* of the terminal holding part 40. See (d) of FIG. 7B.

After the external connection terminal 81 of the external component 80 is inserted in the electrical connector 2, the upper part 51 of the lid 50 that is fitted to the intermediate position of the electrical connector 2 in the semi-assembled state is further pushed in, and the terminal holding part 40 and the lid 50 are fitted to a certain position (butting position) inside the housing 70. See (e) of FIG. 7C. With this, the external connection terminal 81 of the external component 80 is firmly connected with the second connection part 32 of each of the second connection terminals 30, and attachment of the external component 80 to the circuit board 60 having the electrical connector 2 mounted thereon is completed.

[Operation/Working-Effect of Embodiment]

As described above, in the electrical connector 2 according to the second embodiment of the present invention, similarly to the first embodiment, when conducting reflow soldering in a state in which the lid 50 is fitted into the housing 70, suppression of decrease, or assistance of increase, in temperature of the first connection terminals 10 can be conducted, indirectly or directly. Thus, by suppressing insufficient heating of the solder, the performance of soldering (the one end 10*a* of) each of the first connection terminals 10 of the electrical connector 2 to the circuit board 60 can be improved.

Furthermore, in the electrical connector 2 according to the second embodiment of the present invention, since the penetration hole 72*a* is formed on one of the lateral walls 22 of the housing 70, the enter/discharge pathway for the heated air is formed between the penetration hole 72*a* and the penetration holes 51*a* formed on the upper part 51 of the lid 50. With this, during reflow soldering, more of the heated air generated during reflow can be caused to hit the linking part 33 of each of the second connection terminals 30. Thus, by suppressing insufficient heating of the solder, the performance of soldering (the one end 10*a* of) each of the first connection terminals 10 of the electrical connector 2 to the circuit board 60 can be further improved.

In addition, with the electrical connector 2 according to the second embodiment of the present invention, since reflow soldering is conducted in the state in which the lid 50 is fitted in the housing 70 to the intermediate position, productivity can be maintained at a level similar to conventional levels.

[Modification]

Figure 8:
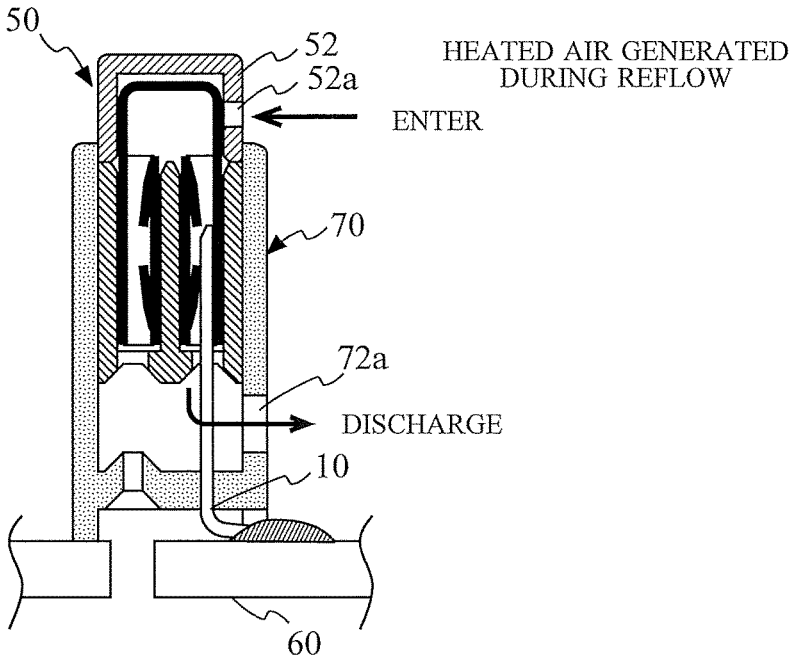
FIG. 8 is for describing a modification of the penetration hole formed on the lid.

In a case where the electrical connector 2 is set in the semi-assembled state and reflow soldering is conducted, the penetration holes 51*a* formed on the lid 50 may be formed at a position other than on the upper part 51. For example, as shown in FIG. 8, a penetration hole 52*a* may be formed on one of the lateral walls 52 of the lid 50 that does not overlap with the lateral walls 22 of the housing 70 when the electrical connector 2 is in the semi-assembled state. Also when the penetration hole 52*a* is formed at this position, part of the heated air that blow during reflow soldering can enter inside the housing 70 from the penetration hole 52*a* on the lid 50.

Application Example

As described above, with the electrical connectors 1 and 2 according to the first and the second embodiments of the present invention, the performance of soldering the first connection terminals 10 to the circuit board 60 can be improved during reflow soldering conducted in a state where the lid 50 is fitted into the housing 20 or 70. As a result, the electrical connector 1 or 2 according to the present embodiments can be densely mounted on the circuit board 60.

Figure 9:
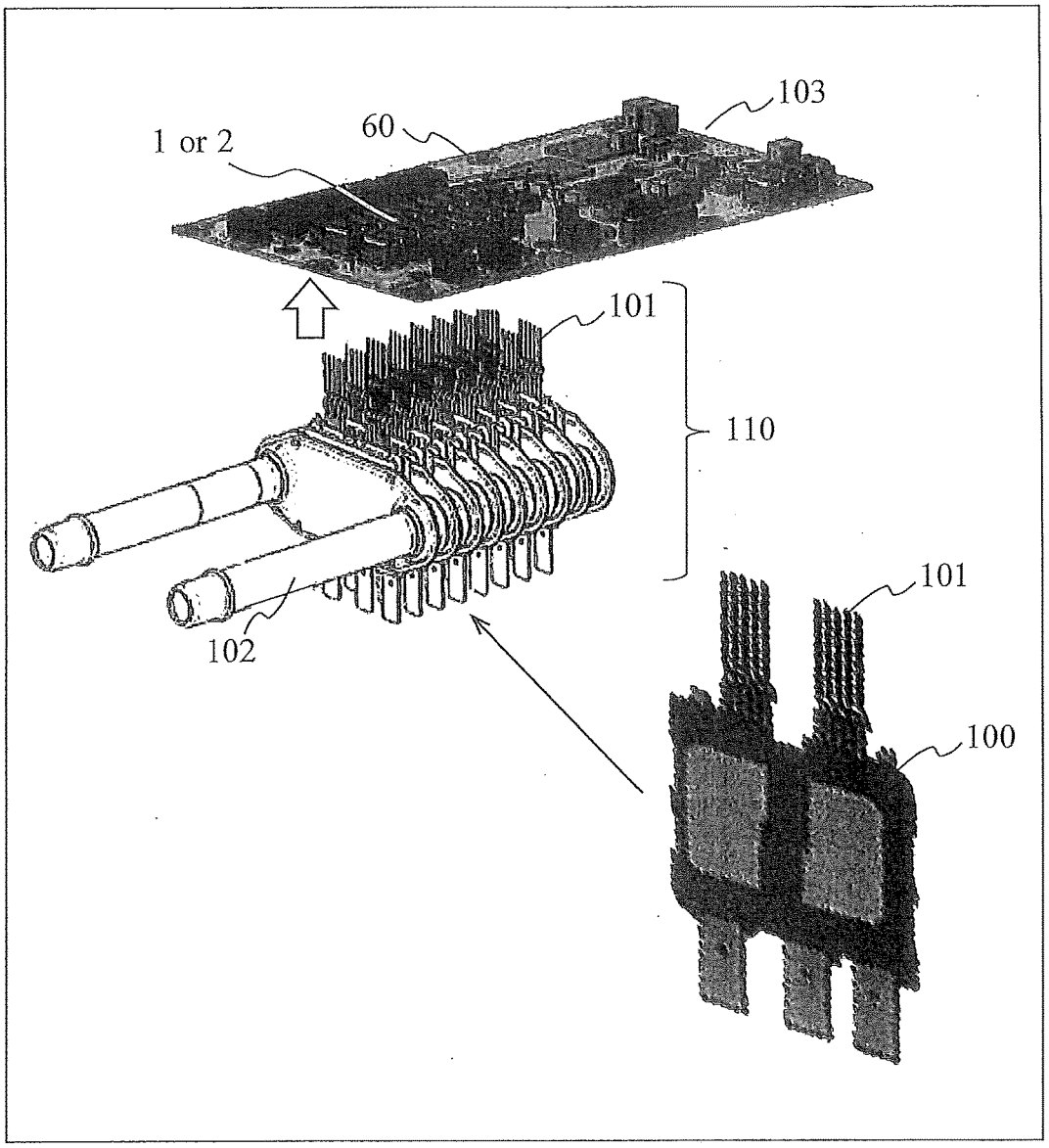
FIG. 9 is for describing an application example of the electrical connector according to the present embodiment.

The circuit board 60 having the electrical connector 1 or 2 densely mounted thereon can be used as, for example, a driving circuit board 103 for driving a semiconductor module 110 (e.g., IPM, etc.) in which tabular power cards 100, obtained by mold-packaging power semiconductor elements, are aligned with small intervals in which a double-sided cooler 102 is interposed, as shown in FIG. 9. In this case, terminals 101 (the external connection terminal 81) of the power cards 100 are inserted, from the back surface of the driving circuit board 103 and through through-holes formed on the driving circuit board 103, in the electrical connector 1 or 2 mounted on the surface of the driving circuit board 103. Each of the terminals 101 (the external connection terminal 81) of the power cards 100 inserted in the electrical connector 1 or 2 passes through the insertion hole 21*a* of the housing 20 or 70 and one of the insertion holes 41*b* of the terminal holding part 40, and is electrically connected with the second connection part 32 of each of the second connection terminals 30. With this, the first connection terminals 10 and the terminals 101 (the external connection terminal 81) of the power cards 100 are electrically connected.

In the driving circuit board 103 of the semiconductor module 110 in which the power cards 100 are aligned with small intervals, the interval is also small between electrical connectors that are mounted. Thus, heated air generated during reflow cannot easily flow between the electrical connectors. When it becomes difficult to cause the heated air to flow between the electrical connectors, the performance of soldering connection terminals of the electrical connectors to the circuit board ordinarily deteriorates. However, with the electrical connector 1 or 2 according to the present embodiments, since the heated air generated during reflow enters inside the housing 20 or 70 from the penetration holes 51*a*, an advantageous effect is obtained in which the performance of soldering the first connection terminals 10 of the electrical connector 1 or 2 to the circuit board 60 does not deteriorate.

While the invention has been described in detail, the foregoing description is in all aspects illustrative and not restrictive. It will be understood that numerous other modifications and variations can be devised without departing from the scope of the invention.

What is claimed is:

1. An electrical connector to be mounted on a circuit board, the electrical connector comprising:

a first connection terminal whose one end is to be electrically connected with the circuit board;

a housing that is configured to support the first connection terminal in a state in which the other end of the first connection terminal is surrounded by lateral walls and disposed inside the housing, and has an opening toward an upper part opposite to a bottom part where the housing makes contact with the circuit board;

a second connection terminal whose one end is to be electrically connected to the other end of the first connection terminal and whose other end is to be electrically connected to an external connection terminal which is to be inserted in the electrical connector; and a lid configured to engage the opening of the housing and cover the other end of the first connection terminal and the second connection terminal, wherein the lid has a penetration hole configured to ventilate the housing by causing a part of air that is applied to the lid from outside of the housing to enter the housing.

2. The electrical connector according to claim 1, wherein when the penetration hole is parallelly projected in a direction perpendicular with respect to the upper part of the lid, a projection shape of the penetration hole is formed at a position that overlaps the second connection terminal.

3. The electrical connector according to claim 1, wherein when the penetration hole is parallelly projected in a direction perpendicular with respect to the upper part of the lid, a projection shape of the penetration hole is formed at a position that overlaps the first connection terminal.

4. The electrical connector according to claim 1, comprising a plurality of the first connection terminals, wherein the lid has a plurality of the penetration holes corresponding to the plurality of the first connection terminals and configured to ventilate the housing.

5. The electrical connector according to claim 2, wherein the penetration hole has a forward tapered shape in which an opening size of the housing becomes smaller from outside toward inside of the housing.

6. The electrical connector according to claim 2, wherein the penetration hole is formed of multiple holes, and each of the multiple holes has a forward tapered shape in which an opening size of the housing becomes smaller from outside toward inside of the housing.

7. A method of mounting an electrical connector on a circuit board and connecting the electrical connector to an external component, the electrical connector including:

a first connection terminal whose one end is to be electrically connected with the circuit board;

a housing that is configured to support the first connection terminal in a state in which the other end of the first connection terminal is surrounded by lateral walls and disposed inside the housing, that has an opening toward an upper part opposite to a bottom part where the housing makes contact with the circuit board, and that has a first penetration hole on at least one of the lateral walls;

a second connection terminal whose one end is to be electrically connected to the other end of the first connection terminal and whose other end is to be electrically connected to an external connection terminal of an external component which is to be inserted in the electrical connector; and a lid that has a second penetration hole through which air passes between an inside and an outside of the housing, and is configured to engage the opening of the housing and cover the other end of the first connection terminal and the second connection terminal, the method comprising:

causing the lid to engage the opening of the housing to an intermediate position where the first penetration hole is not blocked;

placing the electrical connector on the circuit board such that the bottom part of the housing, with which the lid is engaged to the intermediate position, is positioned toward the circuit board;

electrically connecting, in a state in which a ventilation pathway is formed from the second penetration hole to the first penetration hole, the one end of the first connection terminal to the circuit board by conducting reflow soldering on the electrical connector placed on the circuit board;

connecting the other end of the second connection terminal to the external connection terminal of the external component inserted in the electrical connector; and causing, after the other end of the second connection terminal and the external connection terminal of the external component are connected, further engagement of the lid that had been engaged to the intermediate position and closing the first penetration hole.

* * * * *